United States Patent [19]

Bloyd

[11] 4,342,947

[45] * Aug. 3, 1982

[54] LIGHT INDICATING SYSTEM HAVING LIGHT EMITTING DIODES AND POWER REDUCTION CIRCUIT

[76] Inventor: Jon A. Bloyd, 155 Franklin St., Dayton, Ohio 45402

[ * ] Notice: The portion of the term of this patent subsequent to Jul. 8, 1997, has been disclaimed.

[21] Appl. No.: 166,067

[22] Filed: Jul. 7, 1980

Related U.S. Application Data

[63] Continuation of Ser. No. 842,410, Oct. 14, 1977, Pat. No. 4,211,956.

[51] Int. Cl.[3] ..... H05B 43/00

[52] U.S. Cl. ..... 315/199; 315/200 R; 315/291; 315/312; 340/782

[58] Field of Search ..... 315/194, 199, 200 R, 315/208, 291, 312, 324; 307/296, 311; 250/552, 553; 340/762, 782; 323/320, 326; 362/800

[56] References Cited

U.S. PATENT DOCUMENTS 3,454,865 7/1969 Ellert ..... 315/194 X 3,813,664 5/1974 Geyer ..... 307/311 X

*Primary Examiner*—Eugene La Roche

*Attorney, Agent, or Firm*—Jacox & Meckstroth

[57] ABSTRACT

A light indicating monitoring system includes a plurality of light emitting diodes (LED's) having a common ground connected to a phase controlled silicon controlled rectifier (SCR) circuit. The SCR circuit limits conduction of rectified AC energy through the LED's and through corresponding resistors connected in series with the LED's for limiting the current through the LED's. The SCR circuit thereby provides for operating low DC voltage LED's from a high AC voltage source with a minimum of power and heat generation in the current limiting resistors.

9 Claims, 2 Drawing Figures

LIGHT INDICATING SYSTEM HAVING LIGHT EMITTING DIODES AND POWER REDUCTION CIRCUIT

RELATED APPLICATION

This application is a continuation of application Ser. No. 842,410, filed Oct. 14, 1977, now issued as U.S. Pat. No. 4,211,956.

BACKGROUND OF THE INVENTION

As a form of light indicating devices, light emitting diodes (LED's) provide several advantages over incandescent or gas discharge types of indicator lamps. Among these advantages are the small size, exceptionally long life, ruggedness and durability of the LED's and their consistent levels of light output over an extended period of time. Typically, the half-life of an LED, or that point in time at which initial light output is reduced by 50%, is theoretically projected to be approximately twenty years. Because of these advantages, LED's have been widely accepted in a large number of industrial and commercial product applications.

Since LED's typically operate at approximately two volts DC and require an external series current limiting resistor, applications are primarily found in electronic products which operate at lower AC and DC voltages. In higher AC voltage applications, the most common being 120 volts AC, the use of LED's is more difficult due to their lower operating and peak inverse voltage ratings. Specifically, a larger amount of voltage must be dropped across the series current limiting resistor resulting in a correspondingly larger amount of heat energy being generated in that resistor. Typically a rectifying diode is placed in parallel with each LED, and in higher AC voltage applications, a second diode is placed in series with the LED. The series diode is biased in the same direction as the LED, and the parallel diode is biased in the opposite direction of the LED. In 120 volt AC applications, both diodes are typically employed. The series connected diode rectifies the AC voltage and thus reduces the voltage drop across the series current limiting resistor, and the parallel connected diode prevents peak inverse voltages from exceeding those specified for the LED.

Even though the series connected diode rectifies half of a 120 volt AC sine wave, approximately 82 volts RMS must still be dropped across the series current limiting resistor. At this voltage, and at a typical average current through the LED of 15 milliamperes, the RMS power or heat generated in the resistor will be approximately 1.867 watts. In a typical low DC voltage application, such as 5 volts DC, the voltage drop across the series current limiting resistor would be approximately three volts DC, and the power generated in the resistor would be approximately 0.045 watts at a comparable DC current of 15 milliamperes. Thus the power generated in the series current limiting resistor in 120 volt AC applications is excessive when compared to the power generated at lower DC voltages. This excessive power or heat generation problem is compounded when several LED's are used in a particular 120 volt AC application and is further compounded if there is a limited and/or enclosed amount of space in which to locate the current limiting resistors required for each LED. In such cases, temperature rise can rapidly reach levels which can become component destructive.

SUMMARY OF THE INVENTION

The present invention is directed to a light indicating system which preferably includes a plurality of LED's operated from higher AC voltages and a circuit for substantially reducing the electrical power and the heat generated by the series current limiting resistors used in conjunction with each of those LED's. Thus the invention provides a system by which LED's can be more widely used in higher AC voltage applications where voltages are in excess of 50 volt AC, and particularly those applications requiring light indication(s) from 120 volt AC. Furthermore, the invention provides the same power reduction capability when used with one or several LED's, with the maximum number of LED's being determined by the current rating of the SCR used in the power reduction circuit.

DESCRIPTION OF THE PREFERRED EMBODIMENT

Figure 1:
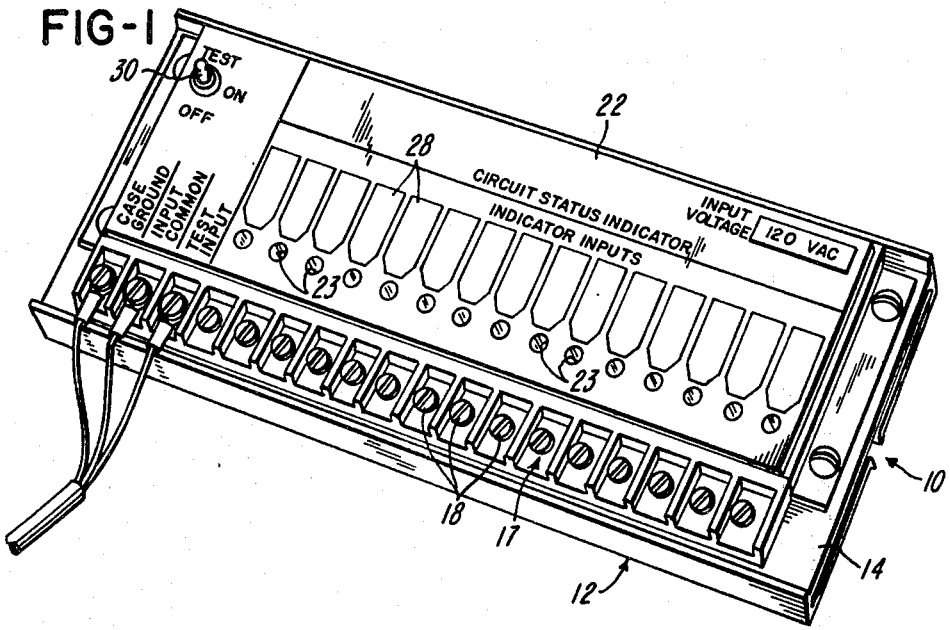
FIG. 1 is a perspective view of a circuit status indicating device incorporating a plurality of LED's and a power reduction circuit constructed in accordance with the invention.

Referring to the drawing, FIG. 1 shows a circuit status indicating device 10 which is typically used for monitoring voltages throughout an electrical or electronic apparatus or system, for example, during the initial setup and debugging of automatic assembly equipment and/or for monitoring the equipment during operation to assure that various electrically controlled devices are each receiving electrical energy at the proper time. The indicating device 10 incorporates a rectangular plastic track or base 12 into which is inserted a printed circuit board 14. An elongated terminal block 17 is mounted on the printed circuit board 14 and includes a row of screw terminals 18 each of which is adapted to be connected to a corresponding electrically operated device which is to be monitored. The three terminals at the far left end of the terminal block 17 provide for connecting the appropriate case ground, input common, and test inut leads or conductors as indicated in FIG. 1.

A formed sheet metal cover 22 is also mounted on the printed circuit board 14 adjacent the terminal block 17 and is provided with a row of openings or holes 23 through which can be observed corresponding light emitting diode (LED's) indicators 26. The cover plate 22 is silk-screen printed with a white space 28 for each of the LED viewing holes 23, and the spaces 28 provide for writing on the cover 22 identifications corresponding to the electrical operations being monitored by conductors connected to the screw terminals 18. The cover plate 22 also identifies a three position on-off-test switch 30 mounted on the printed circuit board 14.

Figure 2:
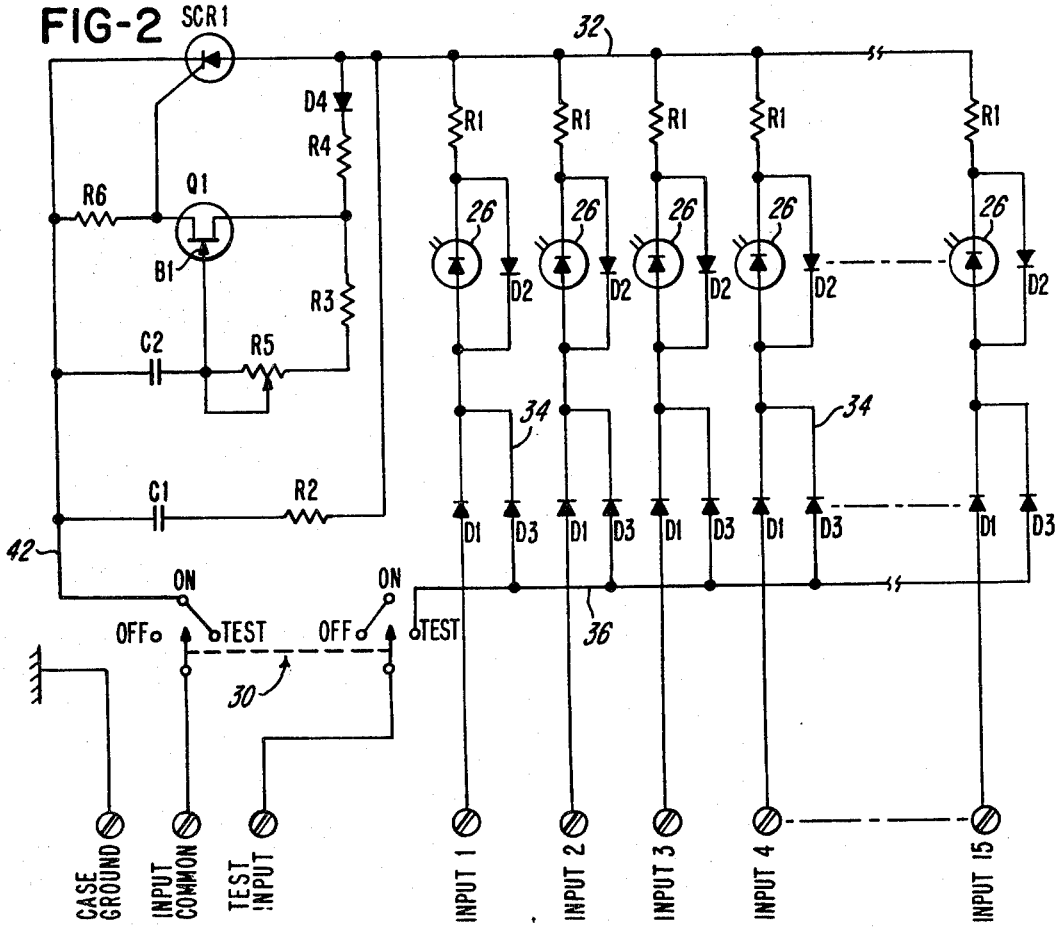
FIG. 2 is a schematic circuit diagram for the indicating device shown in FIG. 1.

Referring to FIG. 2, each of the LED indicators 26 is connected in series with an input isolation rectifier diode D1 and a current limiting resistor R1. Connected in parallel with each of the LED indicators is another rectifier diode D2 which is used for protecting the LED indicator from peak inverse voltages in excess of those for which the LED indicator is rated. All of the LED circuits are connected to a common conductor 32 extending above the resistors R1, and each LED circuit is connected to its corresponding screw terminal 18 located below its corresponding diode D1. Each circuit is also connected by a conductor 34 and diode D3 to a common momentary test conductor 36 extending from the switch 30. If the conductor 32 was connected directly to the input common AC ground conductor 42, and the inputs were at a 120 volt AC at the terminals 18, an excessive amount of power would be dissipated in each resistor R1. As previously stated, if the average current through each LED circuit were 15 milliamperes, the dissipated RMS power in each resistor R1 would be approximately 1.867 watts.

In accordance with the present invention, a silicon controlled rectifier (SCR) power reduction circuit consists of an SCR, an SCR firing circuit, and an electrical noise reduction snubber circuit. The SCR is noted as SCR1. The SCR firing circuit consists of a diode D4 (IN4004), resistors R3, R4 and R6, potentiometer R5, capacitor C2, and unijunction transistor Q1. The snubber circuit consists of a resistor R2 and a capacitor C1. When the SCR power reduction circuit is placed between the common conductor 32 and the input common AC ground conductor 42, the RMS voltage across each resistor R1 may be varied. This variation is accomplished by adjusting the potentiometer R5 which controls the trigger voltage at B1 of unijunction transistor Q1 which, in turn, controls the firing angle and therefore the conduction angle of SCR1.

With potentiometer R5 set at a maximum resistance, the conduction angle is approximately 10 degrees out of a maximum conduction angle of 180 degrees ie., a complete half-sine wave. At this setting of potentiometer R5, SCR1 is a switch which is off, or non-conducting, for 170 degrees of the sine wave and on, or conducting, for 10 degrees. When potentiometer R5 is at a minimum resistance, the conduction angle is increased to approximately 40 degrees of the sine wave. The maximum conduction angle is limited by resistor R3. The RMS voltage across each resistor R1 is therefore much less than it would be with complete 180 degree half-sine wave power. As a result of the smaller conduction angle and corresponding decrease in the RMS voltage across each resistor R1, there is a corresponding decrease in the current through the resistor and therefore the current through the corresponding LED indicator 26. Since the light output of each LED 26 is a function of the current through it, this reduced current is an undesirable effect which is readily overcome by reducing the value of the current limiting resistor R1, which results in a corresponding increase of current through the LED and therefore an increase in the light output of the LED.

The invention which is embodied in the above decribed circuit provides for selecting a combination of R1 resistor values and R5 potentiometer conduction angle which produce average DC current, peak DC current, said LED power dissipation well within the acceptable operating specifications of commercially available LED's. At the same time, RMS voltage, current, and power generated in the R1 resistors are greatly reduced even though the LED indicators 26 are operated from higher AC voltages. Specifically, in the illustrated circuit, a conduction angle of 25 degrees and a resistor R1 value of 214 ohms results in an averge current through the corresponding LED of approximately 15 milliamperes, and an RMS power dissipated in the corresponding resistor R1 of approximately 0.486 watts. This is in comparison to the RMS power dissipation of approximately 1.867 watts previously mentioned with the same average current of approximately 15 milliamperes but at a conduction angle of 180 degrees. Thus, with the illustrated example, there is a power reduction of over 73% (0.486 watts vs. 1.867 watts, both at 15 milliamperes).

While the form of indicating system and power reduction circuit herein described constitutes a preferred embodiment of the invention, it is to be understood that the invention is not limited to this precise form, and that changes may be made therein without departing from the scope and spirit of the invention as defined in the appended claims.

The invention having thus been described, the following is claimed:

1. Apparatus for controlling a component operated by low voltage direct current in response to actuation of a device operated by high voltage alternating current, said apparatus comprising rectifying means including a silicon controlled rectifier connected to said direct current operated component and to said alternating current operated device, said rectifying means being effective to rectify the alternating current received from said device into direct current for said direct current component, said direct current component being connected through a resistor to said rectifier for limiting the direct current through said component, said component being connected to said device through a diode, and voltage phase control means for limiting conduction of the rectified current through said component and said resistor for limiting the heat produced by said resistor.

2. Apparatus as defined in claim 1 and including an electrical noise reduction snubber circuit connected across said silicon controlled rectifier, and said snubber circuit includes a resistor and a capacitor connected in series.

3. Apparatus as defined in claim 1 wherein said phase control means comprise a firing circuit for said silicon controlled rectifier and including a unijunction transistor.

4. Apparatus as defined in claim 3 wherein said firing circuit further includes an adjustable resistor connected to control the trigger voltage of said transistor.

5. Apparatus as defined in claim 4 wherein said firing circuit further includes a capacitor and resistor means connected in series with said adjustable resistor.

6. Apparatus as defined in claim 1 and including a plurality of said low voltage direct current components corresponding to a plurality of the high voltage alternating current devices, each of said components being connected to said rectifier through a corresponding said resistor, and each of said components being connected to its corresponding device through a corresponding said diode.

7. Apparatus as defined in claim 6 wherein each of said low voltage components comprise a light emitting diode.

8. Apparatus as defined in claim 7 and further including a test circuit having switch means for selectively energizing all of said light emitting diodes simultaneously for testing the operation of said light emitting diodes.

9. Apparatus as defined in claim 7 and including a panel supporting said light emitting diodes in a row, and a row of wire receiving contacts on said panel and connected to the corresponding said diodes.

* * * * *